US007648220B2

(12) United States Patent
Farr et al.

(10) Patent No.: US 7,648,220 B2
(45) Date of Patent: Jan. 19, 2010

(54) SENSING OF FLUID EJECTED BY DROP-ON-DEMAND NOZZLES

(75) Inventors: Isaac V. Farr, Corvallis, OR (US); David R. Otis, Jr., Corvallis, OR (US); Casey T. Miller, Corvallis, OR (US); Christie Dudenhoefer, Corvallis, OR (US); Kenneth J. Ward, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 436 days.

(21) Appl. No.: 11/739,057

(22) Filed: Apr. 23, 2007

(65) Prior Publication Data

US 2008/0259107 A1 Oct. 23, 2008

(51) Int. Cl.
*B41J 29/393* (2006.01)

(52) U.S. Cl. ..... 347/19; 347/6; 347/14

(58) Field of Classification Search ..... 347/6, 347/7, 14, 19

See application file for complete search history.

(56) References Cited

U.S. PATENT DOCUMENTS 5,387,976 A * 2/1995 Lesniak ..... 347/19
5,422,664 A 6/1995 Stephany
5,434,430 A 7/1995 Stewart
5,473,351 A 12/1995 Helterline et al.
5,964,032 A 10/1999 Orikasa et al.
6,003,980 A 12/1999 Sheinman et al.
6,126,277 A 10/2000 Feinn et al.
6,196,376 B1 3/2001 Otsuki et al.
6,234,602 B1 5/2001 Soto et al.
6,267,519 B1 7/2001 Otsuki et al.
6,296,341 B1 10/2001 Sugahara et al.
6,299,275 B1 10/2001 Elgee
6,310,637 B1 10/2001 Shimada et al.
6,315,383 B1 11/2001 Sarmast et al.
6,347,857 B1 2/2002 Purcell et al.
6,377,358 B1 4/2002 Hayasaki et al.
6,378,975 B1 4/2002 Elgee et al.
6,450,608 B2 9/2002 Sarmast et al.
6,523,920 B2 2/2003 Tanaka et al.
6,554,390 B2 4/2003 Arquilevich et al.
6,604,807 B1 8/2003 Murcia et al.
6,648,444 B2 11/2003 Valero et al.
6,702,419 B2 3/2004 Stoessel et al.

(Continued)

FOREIGN PATENT DOCUMENTS

JP 2003-254810 A 9/2003

(Continued)

OTHER PUBLICATIONS

L. Setti et al., Thermal Inkjet Technology for the Microdeposition of Biological Molecules as a Viable Route for the Realization of Biosensors, Analytical Letters 37-8(2004).

(Continued)

*Primary Examiner*—Juanita D Stephens

(57) ABSTRACT

Various apparatus and methods relating to determining a quantity measurement of fluid ejected by drop-on-demand nozzles and modifying the ejection parameters based upon the quantity measurement.

21 Claims, 4 Drawing Sheets

U.S. PATENT DOCUMENTS

| | | | | |
|---|---|---|---|---|
| 6,769,756 | B2 | 8/2004 | Su et al. | |
| 7,029,082 | B2 * | 4/2006 | Farr et al. | 347/7 |
| 2004/0027405 | A1 | 2/2004 | Stoessel et al. | |
| 2005/0030332 | A1 | 2/2005 | Masuda | |
| 2006/0001692 | A1 | 1/2006 | Mori | |
| 2006/0183261 | A1 | 8/2006 | Dudenhoefer et al. | |
| 2006/0246574 | A1 | 11/2006 | Rosenstein et al. | |
| 2006/0246599 | A1 | 11/2006 | Rosenstein et al. | |

FOREIGN PATENT DOCUMENTS

| | | | |
|---|---|---|---|
| JP | 2003-288839 | A | 10/2003 |

OTHER PUBLICATIONS

J.D. Newman et al., Ink-Jet Printing for the Fabricaiton of Amperometric Glucose Biosensors, Analytica Chimica Acto, 262(1992)13-17, Elsevier Science Publishers, Amsterdam.

* cited by examiner

SENSING OF FLUID EJECTED BY DROP-ON-DEMAND NOZZLES

CROSS-REFERENCE TO RELATED PATENT APPLICATIONS

The present application is related to co-pending U.S. patent application Ser. No. 11/738,923 filed on Apr. 23, 2007, here with by Christie Dudenhoefer et al. and entitled DROP-ON-DEMAND MANUFACTURING OF DIAGNOSTIC TEST STRIPS, the full disclosure of which is hereby incorporated by reference.

BACKGROUND

Drop-on-demand inkjet printers may experience shifts or changes in performance over the course of their life or in response to environmental or usage factors. Such changes may impact consistency and quality of print performance.

DETAILED DESCRIPTION OF THE EXAMPLE EMBODIMENTS

Figure 1:
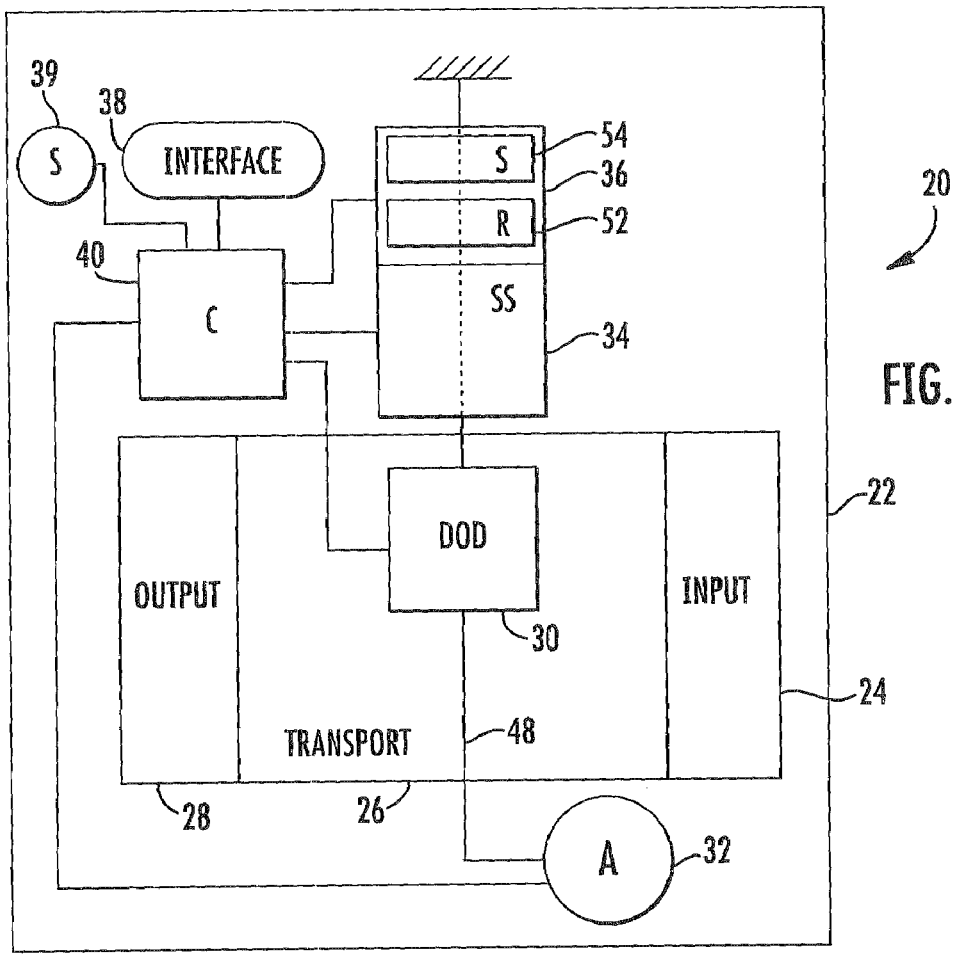
FIG. 1 is a schematic illustration of a printing system according to an example embodiment.

FIG. 1 schematically illustrates printer 20 according to an example embodiment. Printer 20 comprises a self-contained unit configured to deposit fluid onto one or more target media using drop-on-demand inkjet nozzles. Such target media may comprise strips or sheets of material or three-dimensional objects. As will be described hereafter, printer 20 is configured to print or coat fluids upon such target media with enhanced print quality and consistency.

As shown by FIG. 1, printer 20 includes housing 22, input 24, transport 26, output 28, drop-on-demand print head 30, actuator 32, service station 34, sensing system 36, interface 38, sensor 39 and controller 40. Housing 22 comprises one or more structures which serve as a framework, support and enclosure for containing the remaining components of printer 20 as a self-supported and self-contained unit. As a result, each of the noted components of printer 20 may be stored, shipped and utilized without substantial additional assembly. In addition, many of the components may employ a common power connection and may be arranged in a compact architecture. Although housing 22 is schematically illustrated as a box, housing 22 may have a variety of different sizes, shapes and configurations.

Input 24 comprises one or more structures supported by housing 22 configured to store and deliver target media to transport 26. In those embodiments in which the target media comprises sheets of one or more materials, input 24 may comprise a tray or bin. In other embodiments where target media has other geometries, input 24 may have other configurations such as a funnel for singulating individual target media and delivering such singulated target media to transport 26. Input 24 may also support target media that takes the form of continuous rolled material, as in a web-press.

Transport 26 comprises a mechanism configured to receive target media from input 24, to deliver or move the target media relative to print head 30 and to subsequently move the printed upon target media to output 28. In one embodiment wherein the target media comprises sheets of material, transport 26 may comprise a series of rollers, belts, movable trays, a drum, robotic arms and the like. In other embodiments, transport 26 may comprise other mechanisms configured to grasp or hold the target media as a target media is moved with respect to print head 30. In particular embodiments in which the target media is manually positioned with respect to print head 30, transport 26 as well as input 24 and output 28 may be omitted.

Output 28 comprises one or more structures configured to receive printed material upon target media from transport 26. In one embodiment, output 28 may be configured to provide a person with access to the printed upon target media. In another embodiment, output 28 may be configured to be connected to another device or transport for further moving the printed upon target media to another mechanism for further interaction or treatment. In one embodiment, output 28 may comprise a tray or bin. In another embodiment output 28 may comprise a take-up roll for media that takes the form of a continuous roll of material.

Drop-on-demand inkjet print head 30 comprises one or more print heads having a plurality of nozzles 44 (schematically illustrated in FIG. 2) through which fluid is ejected. According to one embodiment, drop-on-demand inkjet print head 30 may comprise a thermoresistive print head. In another embodiment, print head 30 may comprise a piezo resistive print head. According to one embodiment, print head 30 may be part of a cartridge which also stores the fluid to be dispensed. In another embodiment, print head 30 may be supplied with fluid by an off-axis ink supply. Examples of fluid that may be dispensed include, but are not limited to, inks, reagents, solutions including electrically conductive solutes, solutions including electrically semi-conductive solutes, medicinal fluid coatings, polymeric fluid coatings and the like. Examples of target media upon which the fluids may be deposited include, but are not limited to, biochemical diagnostic devices such as test strips, sheets of media, medical devices such as stents and microneedles, electronic devices, circuit boards, flexible circuits and various other two-dimensional and three-dimensional objects. In one embodiment, the fluids may comprise one or more colors of ink, such as cyan, magenta, yellow and black and print head 30 may be configured to eject the one or more inks onto a sheet of media, such as a cellulose-based sheet (paper, photo paper, card stock and the like) to form an image on the sheet. For purposes of this disclosure, and "image" includes drawings, pictures, photographs, text or other visible graphics.

Actuator 32 comprises a mechanism operably coupled to print head 30 configured to move print head 30 between a printing position (shown in FIG. 1) in which print head 30 is located opposite to a target media position by transport 26, a second position in which print head 30 is located opposite to service station 34 for servicing of print head 30 and a third position (shown in FIG. 2) in which print head 30 is positioned opposite to sensing system 36 for determining changes in the performance of print head 30. According to one embodiment, print head 30 is configured to slide or move along a guide 48, such as a rod, bar or rack gear. Actuator 32 may comprise a motor operably coupled to print head 30 by a drive train or transmission. In other embodiments, actuator 32 may comprise an electric solenoid, or hydraulic or pneumatic cylinder assembly.

Service station 34 comprises an arrangement of components configured to service print head 30. Examples of servicing operations include, but are not limited to, spitting and wiping. Servicing operations may also include capping, vacuum prime, and individual nozzle presence detection. For example, in one embodiment, service station 34 may include a spittoon into which print head 30 may spit or eject fluid to clear nozzles 44. Service station 34 may additionally include a blade or fabric belt configured to contact and wipe nozzles 44 to remove accumulated debris about nozzles 44. Although service station 34 is illustrated as being on the same side of transport 26 as sensing system 36, in other embodiments, service station 34 and sensing system 36 may be on opposite sides of transport 26. In other embodiments, service station 34 may be omitted.

Sensing system 36 comprises a system or arrangement of components configured to sense one or more characteristics of fluid ejected by nozzles 44 of print head 30. The sensed characteristics are communicated to controller 40, enabling controller 40 to adjust operating parameters of print head 30 to accommodate changes in characteristics of the fluid ejected by nozzles 44 over time. In one embodiment, the characteristics sensed by sensing system 36 have a sufficient degree of correlation to a volume or quantity of the ejected fluid that controller 40 may use such sensed characteristics to determine or estimate quantity measurements that have a coefficient of variation (standard deviation/mean) (standard deviation divided by mean) of less than or equal to about +/−ten percent. This level of precision and accuracy provides printer 20 with the ability to precisely and accurately deposit control the volumes or quantities of fluid or solute onto a target media over time by sensing and adjusting ejection parameters using the sensed characteristics. This ability enables printer 20 to deposit fluid or coatings upon surfaces of biochemical diagnostic devices such as test strips, medical devices such as stents and microneedles, electronic devices, circuit boards, flexible circuits and various other two-dimensional and three-dimensional objects where relatively large quantities of fluid (at least about one nanoliter (nL) coated upon a surface must be accurately and precisely controlled. In one embodiment, the sensed characteristics include a volume or mass of fluid or solute contained in a single drop or droplet or a predetermined quantity of droplets ejected by a single nozzle 44 or a selected group of nozzles 44 (or a characteristic which corresponds to the volume or mass of ejected fluid).

Sensing system 36 facilitates printer 20 determining if a nozzle or group of nozzles are ejecting droplets that have a lesser or greater amount or volume of fluid than expected or desired and facilitates recalibration or adjustment by controller 40 to subsequently direct the nozzle or group of nozzles to eject a larger or smaller number of droplets such that the actual quantity of fluid ejected and received at a target location more closely approximates a desired quantity. In other embodiments, controller 40 may additionally or alternatively generate control signals to adjust the printhead temperature (set by energy dissipated in the print head) to set and adjust droplet size and shape. As a result, greater control over the actual amount of fluid being ejected by a single nozzle 44 or a selected group of nozzles 44 may be achieved.

Sensing system 36 includes a receiver 52 and sensor 54. Receiver 52 comprises a structure configured to receive one or more fluid droplets ejected through nozzles 44 of print head 30. Receiver 52 may be configured to concurrently receive one or more droplets ejected through multiple nozzles 44 or may alternative be configured to receive droplets ejected through a single nozzle 44. In one embodiment, receiver 52 may include sidewalls or depressions, such as when receiver 52 comprises wells, to retain ejected fluid. In another embodiment, receiver 52 may comprise a plate or substantially flat receiving substrate.

Sensor 54 comprises a device configured to sense the one or more characteristics of the ejected fluid from the one or more nozzles 44. In one embodiment, sensor 54 determines one or more characteristics of the ejected fluid after the fluid has been ejected and prior to the fluid being received by receiver 52. In another embodiment, sensor 54 is configured to sense the one or more characteristics of the ejected fluid after the ejected fluid has been received by or has made contact with receiver 52.

In one embodiment, sensor 54 comprises a well reader, wherein receiver 52 comprises a well plate or microtiter plate. As a result, receiver 52 may concurrently receive fluid droplets ejected from a single nozzle 44 or from multiple nozzles 44 or a selected grouping of nozzles 44. Likewise, sensor 54 may concurrently detect the one or more characteristics of fluid ejected from multiple nozzles 44. The well reader is configured to emit and direct light or electromagnetic radiation towards the ejected fluid contained within receiver 52 to sense an optical property of the ejected fluid such as absorbance, fluorescence, phosphorescence, luminescence or scattering among others. In other embodiments, the well reader may be configured to detect a conductivity of the ejected fluid within the well plate. This sensed information regarding the fluid property is communicated to controller 40 to determine a volume or quantity measurement of the ejected fluid. In other embodiments, other characteristics may be determined using information sensed by system 36 and communicated to controller 40. According to one embodiment, receiver 52 comprises a well plate and sensor 54 comprise well plate reader known as the Synergy HT Multi-Detection Microplate Reader commercially available from Bio-Tek Instruments Inc. In other embodiments, other well plates and well plate readers may be utilized. Because system 36 may comprise a well plate reader, sensing system 36 may be more reliable, robust and easy to modify for incorporation as part of printer 20.

In yet other embodiments, sensor 54 may comprise other mechanisms or metrology tools configured to detect a characteristic of the ejected fluid that has a sufficient degree of correlation to a volume or mass (hereafter collectively referred to as quantity) of ejected fluid so as to enable determination of quantity measurements that have a co-efficient of variation of less than or equal to about +/−ten percent. For example, in other embodiments, sensor 54 may alternatively comprise a capacitive sensing device; a conductive sensing device; a gravimetric sensing or balance device and a scattering sensing device. A gravimetric sensing device or a scattering sensing device may be employed in ejected volumes of fluid that are sufficiently large such that evaporation does not increase the coefficient of variation to greater than about +/−ten percent. The gravimetric sensing device may also be used for large and small fall unit of ejected fluid will still up achieving the desirable coefficient of variation.

A capacitive sensing or measuring device senses a dielectric difference between air and whatever is between two opposite plates, i.e. one or more drops, to determine a quantity of the one or more drops. A laser diffraction sensing device uses a single or dual beam to measure flight time of the droplet and to determine a quantity of the droplet based on kinetic energy of the droplet. A spot size vision sensing device measures a spot size of one or more droplets upon a surface, such as receiver 52 and based upon the spot size determines a quantity of the ejected drop of fluid.

With a conductive sensing device, the conductivity of a fluid in a receiver is detected. For example, the conductivity of the fluid in a well plate may be detected. With a gravimetric sensing or balance device, fluid droplets are ejected onto a sensitive balance or scale, wherein the weight of the droplets is used to determine a quantity of the ejected droplets. With a scattering sensing device, droplets are ejected onto a receiver forming a spot. An x-ray, or another type of ray, such as a ray of visible light, is caused to impinge the spot resulting from the droplets ejected. The resulting scattering of the rays is then measured to determine a quantity of the ejected droplets based on how much the ray scattering deviates from an expected ray scattering. For some of the sensors that examine material after it has impacted the receiver (spot size, spot conductivity, etc) the receiver may be either (a) a special receiver designed for metrology purposes or (b) the actual device which is to be coated (e.g. a stent, implant, or diagnostic strip). One advantage of the latter is that the material jetted for metrology purposes ends up being used in the actual device, tending to increase process yield and decrease waste of the jetted material.

Interface 38 comprises one or more devices configured to facilitate entry of commands or instructions to controller 40. In one embodiment, interface 38 is configured to facilitate entry of commands or instructions from user of printer 20. For example, interface 38 may comprise a mouse, touchpad, touch screen, keyboard, button, switch, camera or microphone with appropriate voice or speech recognition software. In another embodiment, interface 38 may be configured to facilitate receipt of control signals from an external electronic device. For example, interface 38 may comprise a port by which a cable may be connected to printer 20 for transmission of control signals to controller 40. Interface 38 facilitates entry of commands instructing controller 40 to determine the quantity or other characteristics of ejected fluid by print head 30 and to make appropriate adjustments to controller 40 at selected times or intervals or based upon selected usage thresholds of printer 20.

Interface 38 further facilitates entry of information related to characteristics of the fluid being ejected, such as a type of fluid or chemical properties of the fluid, wherein controller 40 may make different ejection parameter adjustments based upon information from sensing system 36 depending upon the type or characteristic of fluid to be ejected. For example, controller 40 may generate a first set of control signals to eject a first quantity of a first fluid with a nozzle or grouping of nozzles based on information received from sensing system 36 and may generate a second distinct set of control signals to eject the same first quantity of a second chemically distinct fluid with the same nozzle or grouping of nozzles based upon information received from sensing system 36, when controller 40 receives an indication via interface 38 that the second fluid is to be ejected. In particular embodiments, controller 40 may be configured to automatically sense actual ejection characteristics in response to receiving information that a different type of fluid is being ejected.

Sensor 39 comprises one or more sensing devices configured to sense one or more factors which may have an impact upon the ejection characteristics of print head 30. In one embodiment, sensor 39 may comprise one or more sensing device configured to sense environmental conditions such as temperature or humidity. Sensor 39 is further configured to transmit such information to controller 40. Based upon such information, controller 40 may make different ejection parameter adjustments based upon information from sensor 39 and based upon information from sensing system 36. In particular embodiments, controller 40 may be configured to automatically initiate a sensing of actual ejection characteristics in response to receiving information indicating a change in environmental conditions. In other embodiments, sensor 39 may be omitted.

Controller 40 comprises one or more processing units configured to generate control signals directing the operation of transport 26, print head 30, actuator 32, service station 34 and sensing system 36. Controller 40 is further configured to receive and analyze signals from sensing system 36, interface 38 and sensor 39. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 40 may be embodied as part of one or more application-specific integrated circuits (ASICs). Unless otherwise specifically noted, the controller is not limited to any specific combination of hardware circuitry and software, nor to any particular source for the instructions executed by the processing unit.

Figure 2:
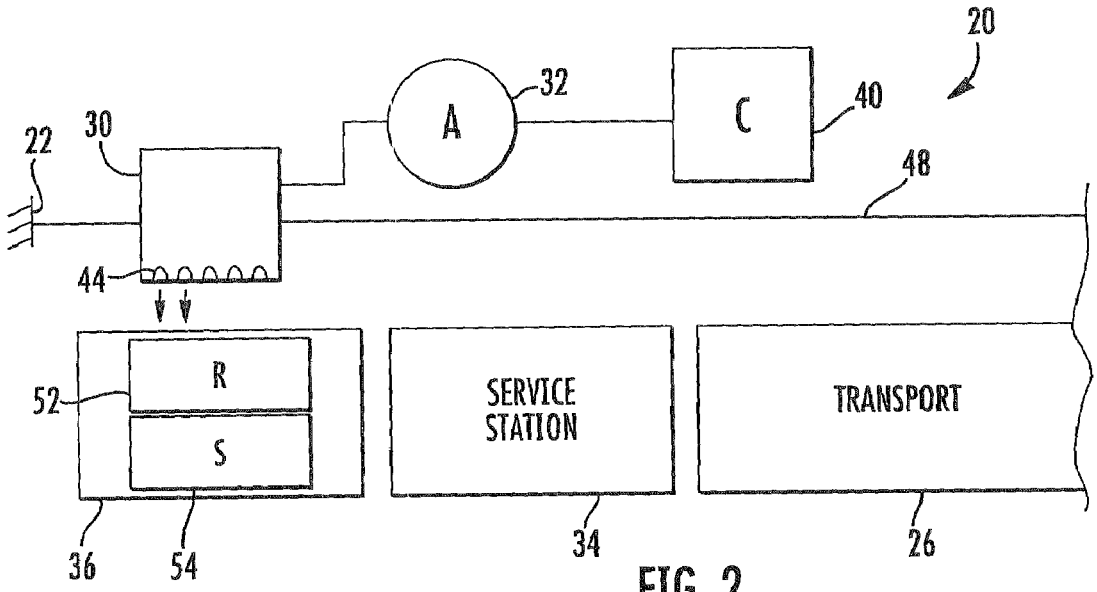
FIG. 2 is a fragmentary schematic illustration of a portion of the printing system of FIG. 1 according to an example embodiment.
Figure 3:
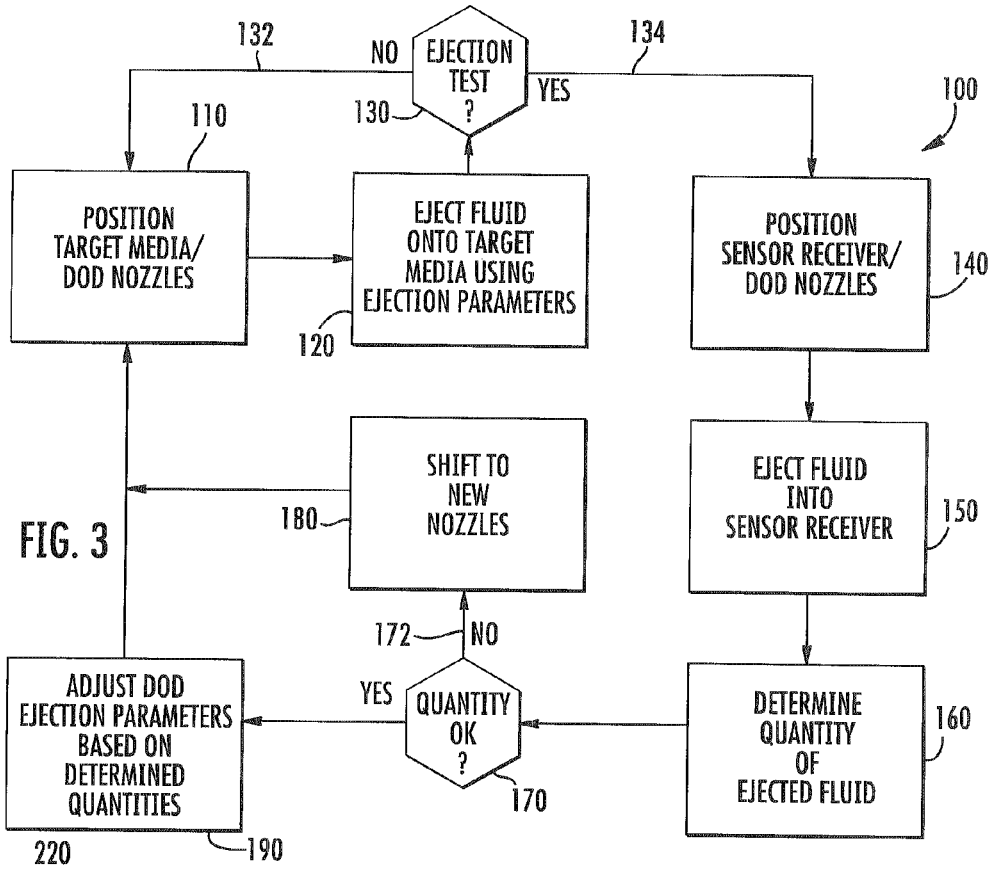
FIG. 3 is a flow diagram of an example method for adjusting print head ejection parameters according to an example embodiment.

FIG. 3 is a flow diagram illustrating an example method 100 by which printer 20 may operate under direction of control signals from controller 40. In the example shown in FIG. 3, method 100 is a closed loop arrangement of steps providing printer 20 with closed loop feedback regarding ejection characteristics of the fluid being ejected, facilitating closed-loop calibration or adjustment. As indicated in step 110, controller 40 generates control signals directing actuator 32 to position nozzles 44 of print head 30 (shown in FIGS. 1 and 2) opposite to transport 26 as shown in FIG. 1 such that print head 30 is generally opposite to target media being carried by transport 26.

As indicated by step 120, controller 40 generates control signals directing one or more nozzles 44 of print head 30 to eject fluid onto the target media using existing ejection parameters. The ejection parameters may include the number of droplets to be used to eject a quantity of fluid from one or more nozzles. The number of droplets ejected may be controlled by varying the total firing energy applied to a nozzle. The fire energy may include the intensity of the firing energy, voltage, pulse width or frequency, as well as the duration in which fluid is ejected through a nozzle or the grouping of nozzles. Controller 40 generates control signals such that the target media is coated in a pattern or image with one or more fluids. As noted above, the target media may be two-dimensional or three-dimensional.

As indicated by step 130, controller 40 makes a determination as to whether actual ejection characteristics, such as ejection quantity, should be sensed using sensing system 36. In one embodiment, controller 40, following instructions contained within a memory in the form of software or computer readable program, or per architecture of an ASIC, may be configured to automatically initiate sensing of ejection characteristics using sensing system 36 at predetermined times. For example, a user of printer 20 may instruct controller 40, through interface 38, to perform such ejection characteristic sensing or testing every Saturday at 1 p.m. or once every three days. In another embodiment, controller 40 may be configured to perform such ejection characteristic sensing or testing after an amount of fluid ejected by a particular nozzle, a particular group of nozzles or the entire print head 30 has exceeded a predetermined threshold entered via interface 39 or programmed into printer 20 during construction of printer 20. In yet other embodiments, controller 40 may be configured to automatically initiate ejection characteristic sensing in response to instructions received via interface 38 directing immediate testing, in response to signals received from interface 38, such as in response to an operator's request or another sensor indicating that the type of fluid being ejected has changed or in response to signals from sensor 39 indicating a change in environmental conditions.

As indicated by arrow 132, if the sensing of ejection characteristics is not to occur, step 110 and 120 are repeated to continue to print or coat the one or more fluids upon the one or more target media. As indicated by arrow 134 and by step 140, if controller 40 determines that the ejection characteristics are to be tested, controller 40 generates control signals to position sensing system 36 and nozzles 44 of print head 30 opposite to one another. In the particular example illustrated in FIG. 1, controller 40 generates control signals directing actuator 32 to move print head 30 to a position opposite to sensing system 36 as seen in FIG. 2. In particular embodiments, controller 40 may additionally generate control signals causing actuator 32 to also position print head 30 opposite to service station 34 for servicing while the printing of fluids is already being interrupted. By servicing print head 30 at service station 34 prior to performing ejection characteristic testing or sensing, printer 20 reduces the likelihood of aberrational results resulting from temporary and removable buildup of residue on or adjacent to nozzles 44. In other embodiments, servicing a print head 30 may be performed other times without testing ejection characteristics.

As indicated by step 150, once nozzles 44 of print head 30 are positioned opposite to receiver 52 of the sensing system 36, controller 40 generates first control signals directing print head 30 to eject fluid into the receiver 52 as shown in FIG. 2. In one embodiment, receiver 52 may be substantially empty prior to receiving such fluid. In another embodiment, receiver 52 may include a chemical reagent solution added either before or after the ejected fluid from the one or more nozzles is received.

As indicated by step 160, controller 40 generates control signals directing sensor 54 to determine characteristics of the ejected fluid. In one embodiment, the characteristics of the ejected fluid may be determined prior to the ejected fluid being received by receiver 52. In another embodiment, the characteristics of the ejected fluid may be determined after the ejected fluid has been received by receiver 52.

According to one embodiment, the characteristics of the ejected fluid comprises an absorptivity of the ejected fluid. Such characteristics are further utilized by controller 40 to determine other ejection characteristics. For example, in one embodiment wherein receiver 52 comprises a well plate and sensor 54 comprises a well plate reader, controller 40 generates control signals directing the well plate reader to sense an absorptivity of the ejected fluid contained within the wells of the well plate. Controller 40 determines a volume of the ejected fluid from the particular nozzle or a selected group of nozzles based upon the sensed absorptivity. For example, controller 40 may consult one or more look-up tables correlating sensed absorptivity to drop volume. Controller 40 may determine fluid volume or quantity by applying one or more formulas or algorithms to the absorptivity values. In other embodiments, the quantity of the fluid may be determined in other fashions, depending upon characteristics of receiver 52 and sensor 54.

As indicated by step 170, upon determining ejection characteristics of the ejected fluid, controller 40 determines whether the determined ejection quantity satisfies a predetermined threshold. For example, in one embodiment, controller 40 may be configured to compare the determined quantity of ejected fluid to a threshold value for the amount of fluid that must be ejected for continued use of a particular nozzle or reflected group of nozzles. As indicated by arrow 172 and step 180, if the determined ejected quantity does not satisfy the threshold criteria within the adjustable range of a nozzle or group of nozzles, controller 40 may generate control signals to either (a) change the number of droplets ejected on to the receiver (increasing the number of drops jetted per pattern, for example, to account for a reduced drop volume) or (b) discontinue use of the particular nozzle or group of nozzles tested and shift to use a new nozzle or new grouping of nozzles for further printing. In the latter case, a new nozzle or group of nozzles is used for printing upon target media. In some embodiments, prior to use of the new nozzle or new grouping of nozzles, controller 40 may be configured to automatically perform ejection testing on the new nozzles per steps 140-170

As indicated by step 190, if the determined quantity of the ejected fluid satisfies the criteria pursuant to step 170, controller 40 uses such determined ejected quantity to recalibrate, fine tune or adjust the current ejection parameters. For example, if the determined quantity of ejected fluid was less than expected quantity for the given number of droplet ejected by the one or more nozzles based upon the first control signals, controller 40 may adjust the ejection parameters such that the second distinct control signals will be generated directing the one or more nozzles to eject a greater number of droplets for a desired quantity of fluid to be ejected. Once such adjustments are made, use of printer 200 to print upon target media resumes.

Figure 4:
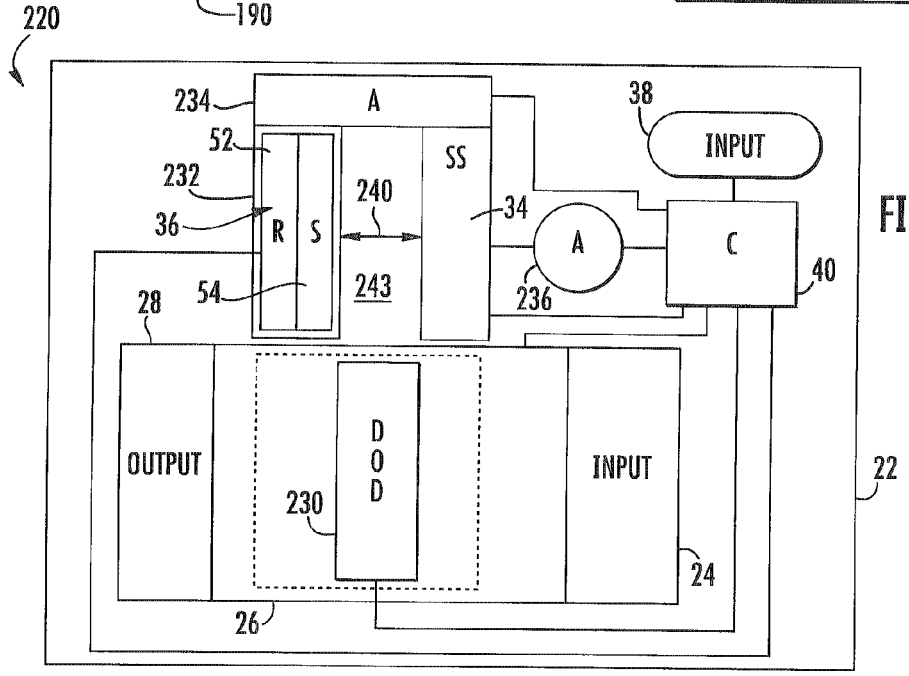
FIG. 4 is a schematic illustration of another embodiment of the printing system of FIG. 1 according to an example embodiment.

FIG. 4 schematically illustrates printer 220, another embodiment of printer 20. Printer 220 is similar to print head 20 (shown in FIG. 1) except that printer 220 includes print device 230 in lieu of a print head 30, carriage 232, actuator 234 and actuator 236 in lieu of actuator 32. Those remaining elements of printer 220 which correspond to elements of printer 20 are numbered similarly. Print device 230 is similar to print head 30 in that print device 230 includes an array of drop-on-demand inkjet nozzles 44 (shown in FIG. 2) through which fluid is ejected. Unlike print head 30, print device 230 is supported in a stationary fashion by housing 22 above media transport 26. In one embodiment, print device 230 may comprise a page-wide-array print head. In other embodiments, print device 230 may have other configurations.

Carriage 232 comprises a structure movably supporting service station 34 and sensing system 36 for movement between a print device withdrawn or inactive position (shown in solid lines) and an active position (shown in broken lines). Carriage 232 additionally supports service station 34 and sensing system 36 for movement in directions indicated by arrows 240. As a result, service station 34 and sensing system 36 may alternately be positioned into alignment with print device 230. In addition, servicing system 34 may be moved in the direction indicated by arrows 240 during servicing of print device 230, such as during wiping. In other embodiments, carriage 232 may alternatively be configured for movably supporting sensing system 36. In some embodiments, carriage 232 may be omitted where sensing system 36 is disposed in the transport 26 opposite to print device 230 and access is provided to sensing system 36 through transport 26.

Actuator 234 comprises a mechanism configured to selectively move service station 34 and sensing system 36 to a position 243 which is directly across from and aligned with print device 230. In one embodiment, actuator 234 may comprise a motor operably coupled to service station 34 and sensing system 36 by a drive train to selectively position sensing system 34 or sensing system 36 in the aligned position 243. In other embodiments, actuator 234 may comprise one or more solenoids or hydraulic or pneumatic cylinder assemblies. In other embodiments where carriage 232 supports sensing system 36 and does not support service station 34, actuator 234 may be omitted.

Actuator 236 comprises an actuator configured to move carriage 232 between the inactive and active positions. In one embodiment, actuator 236 may comprise a motor operably coupled to carriage 232 by a drive train. For example, in one embodiment, actuator 236 may comprise a motor operably coupled to carriage 232 by a rack-and-pinion arrangement. In other embodiments, actuator 236 may comprise one or more electric solenoids or one or more hydraulic or pneumatic cylinder assemblies. In one embodiment, actuator 236 moves carriage 232 and its supported service station 34, sensing system 36 to position opposite print device 230 between transport 26 and print device 230. In other embodiments, actuator 236 may be configured to move carriage 232 to a position below transport 26, wherein transport 26 is itself movable to permit fluid ejected by print device 230 to be received by receiver 52 of sensing system 36.

According to one embodiment, printer 220 may operate using method 100 described above with respect to FIG. 3. However, in step 140, controller 40 generates control signals directing actuators to 34 and 236 to position receiver 52 opposite to one or more nozzles of print device 230. The remaining steps of method 100 may be similarly performed with printer 220.

Although printer 220 is described as moving carriage 232 to a position opposite to print device 230, in other embodiments, print device 230 may be positioned opposite to service station 34 and sensing system 36 in other manners. For example, in other embodiments, carriage 232 may be omitted and actuator 236 may be replaced with actuator 32 configured to move the device 230 to area 242, wherein actuator 234 shuttles either service station 34 or sensing system 36 to a position opposite device 230. In yet another embodiment, actuator 234 may additionally be omitted, where such an actuator 32 is also configured to shuttle device 230 in the directions indicated by arrows 240 to selectively position device 230 opposite to either service station 34 or sensing system 36. Although service station 34 is illustrated as being on the same side of transport 26 as sensing system 36, in other embodiments, service station 34 and sensing system 36 may be on opposite sides of transport 26.

Figure 5:
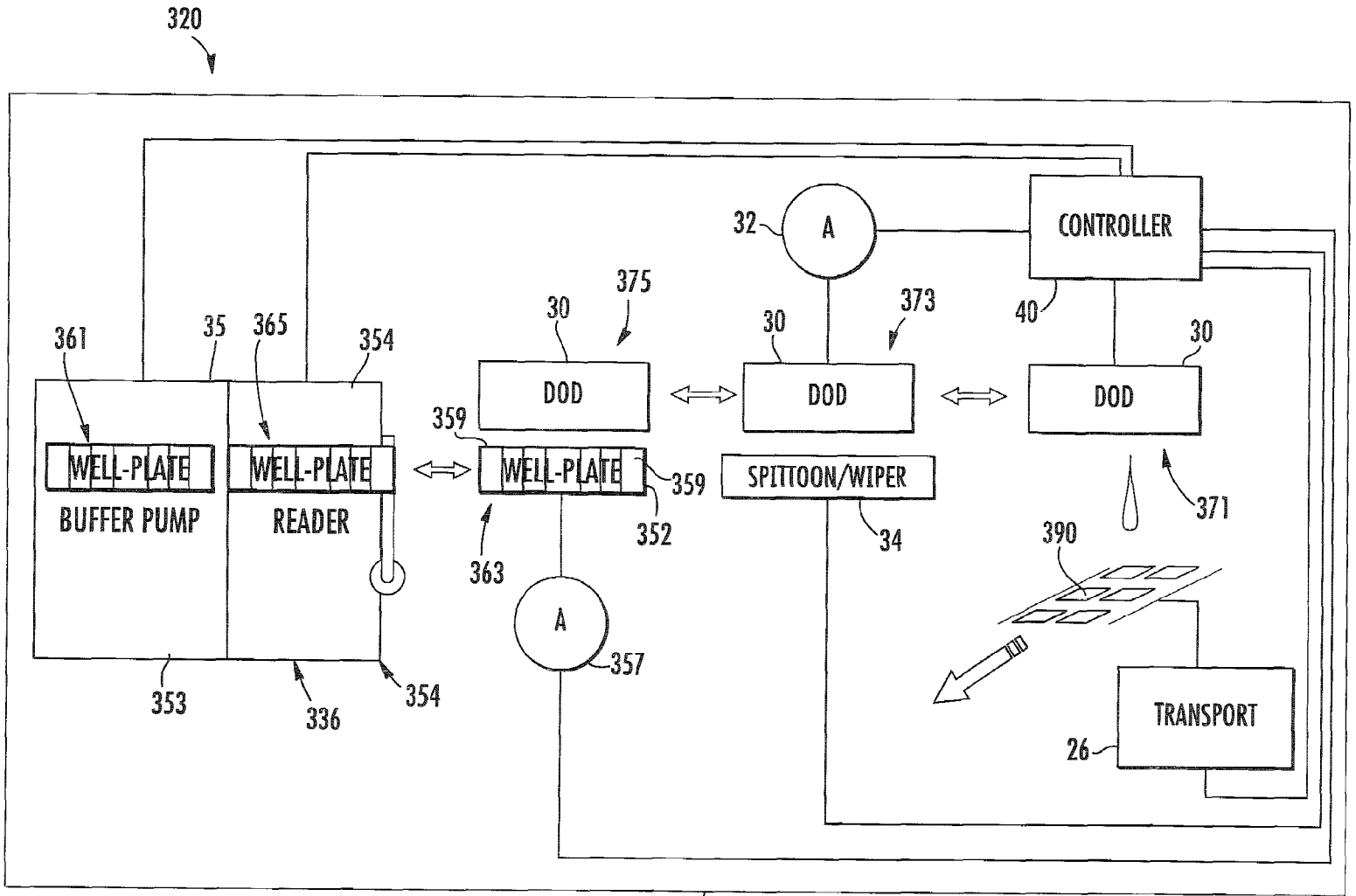
FIG. 5 is a schematic illustration of another embodiment of the printing system of FIG. 1 according to an example embodiment.

FIG. 5 schematically illustrates printer 320, another embodiment of printer 20. FIG. 5 illustrates components of printer 320 in multiple positions for illustrating operation of printer 320. Printer 320 includes housing 22, input 24 (shown in FIG. 1), transport 26, output 28 (shown in FIG. 1), drop-on-demand print head 30, actuator 32, service station 34, sensing system 36, interface 38 (shown in FIG. 1), sensor 39 (shown in FIG. 1) and controller 40. As shown by FIG. 5, printer 320 is similar to printer 20 except that printer 320 includes sensing system 336, a particular embodiment of a sensing system 36 shown in described with respect to FIG. 1. Those remaining elements of printer 320 which correspond to elements of printer 20 are numbered similarly.

Sensing system 336 is configured to sense an optical property of fluid ejected by print head 30, enabling controller 40 to use the sensed optical property to determine other characteristics of the ejected fluid, such as its quantity. Sensing system 336 includes well plate 352, chemical reagent pump 353, well plate reader 354 and actuator 357. Well plate 352 comprises a plate or structure including multiple cells or wells 359 (schematically shown) configured to receive the fluid ejected by print head 30. In one embodiment, well plate 352 comprises a generally disposable article removably carried by actuator 357 with respect to pump 353 and reader 354. According to one embodiment, well plate 352 comprises a 96 well plate. In other embodiments, well plate 352 may have greater or fewer of such wells.

Pump 353 comprise a device configured to deposit a chemical reagent and/or buffer fluid into those wells, of well plate 352 which are to receive fluid ejected from print head 30. Well plate reader 354 comprises a device configured to emit light radiation of a particular wavelength or wavelengths into each of wells 359 and to measure the amount of light radiation transmitted through the fluid in the wells 359 to sense an absorptivity of the fluid within one or more of wells 359. According to one embodiment, pump 353 and well plate reader 354 comprise a Synergy HT Multi-Detection Microplate Reader with auto-fill capability and commercially available from Bio-Tek Instruments Inc. In other embodiments where buffer or chemical reagent is not added pump 353 may be omitted.

Actuator 357 comprises a mechanism configured to move and carry well plate 352 between a chemical reagent or buffer filling position 361 opposite or adjacent to pump 353, a receiving position 363 opposite to print head 30 and a sensing or reading position 365 opposite or adjacent to one or more sensing elements of well plate reader 354. In one embodiment, actuator 357 (schematically shown) may comprise a conveyor or belt driven by a motor. In other embodiments, actuator 357 may comprise a tray driven by a motor or linearly moved by an electric solenoid or one or more hydraulic or pneumatic cylinder assemblies. In other embodiments, actuator 357 may have other configurations.

Figure 6:
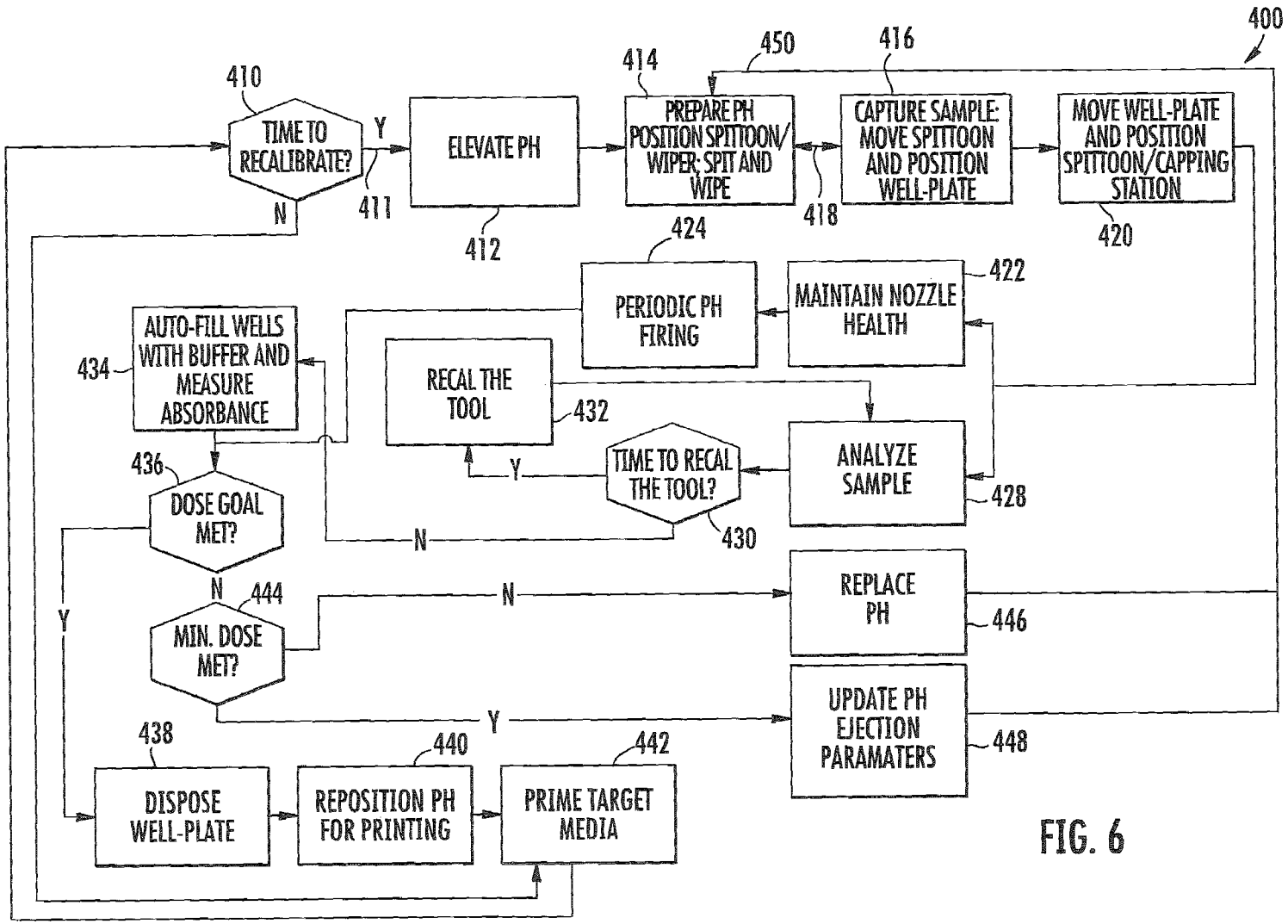
FIG. 6 is a flow diagram of another example method for adjusting print head rejection parameters according to an example embodiment.

FIG. 6 is a flow diagram of an example method 400 which may be executed by printer 320. As indicated by step 410, controller 40 determines whether it is time to sense ejection characteristics and recalibrate the ejection parameters of the print head of the cartridge or pen. In one embodiment, controller 40, following instructions contained within a memory in the form of software or computer readable program, or per architecture of an ASIC, may be configured to automatically initiate sensing of ejection characteristics using sensing system 336 (shown in FIG. 5) at predetermined times. In another embodiment, controller 40 may be configured to perform such ejection characteristic sensing or testing after an amount of fluid ejected by a particular nozzle, a particular group of nozzles or the entire print head 30 has exceeded a predetermined threshold. In yet other embodiments, controller 40 may be configured to automatically initiate ejection characteristic sensing in response to instructions received via interface 38 (shown in FIG. 1) directing immediate testing, in response to signals received from interface 38, such as an operator request or another sensor indicating that the type of fluid being ejected has changed or in response to signals from sensor 39 (shown in FIG. 1) indicating a change in environmental conditions.

As indicated by arrow 411, if controller 40 determines that it is time to recalibrate ejection parameters, controller 40 proceeds to step 412. As indicated in step 412, controller 40 generates control signals such that print head 30 is moved with respect to transport 26 (shown in FIG. 5). The direction of movement for the print head 30 may be along the x-, y- or z-axis. As indicated by step 414, controller 40 generates control signals directing actuator 32 to move print head 30 from a printing position 371 to a servicing position 373 (shown in FIG. 5). In the servicing position 373, print head 30 is positioned opposite to service station 34. In step 414, spitting and wiping servicing operations are performed on print head 30.

As indicated by step 416, controller 40 generates control signals directing actuator 32 to move print head 30 to a sensing position 375 (shown in FIG. 5) generally opposite to well plate 352. At the same time, actuator 357 positions well plate 352 opposite to print head 30. Once print head 30 and well plate 352 are properly positioned with respect to one another, controller 40 generates control signals directing print head 30 to eject fluid from one or more nozzles into corresponding aligned wells 359 of well plate 352. Although not shown, an ionized air blower may be used to minimize electrostatic build up on the nozzles or wells 359.

As indicated by arrows 418, steps 414 and 416 may be repeated as desired depending upon the number of nozzles or nozzle groupings to be sensed or tested. In particular, different regions of print head 30, having different sets of nozzles, may be positioned across different corresponding sets of wells 359 to test different nozzles. The positioning of nozzles over particular wells can be achieved by moving the pen or the wellplate or both. After ejected fluid samples from a particular set or region of nozzles have been received by a corresponding set of wells 359 per step 416, print head 30 is moved back to servicing position 373 for spitting and wiping once again before moving print head 30 back to a sensing position 375 for capturing additional samples from different nozzles or the same nozzles by a different set of wells 359. Servicing of print head 30 between the capture of different samples from the nozzles assists in achieving more reliable results.

As indicated by step 420, after a desired number of samples from a desired number of nozzles have been collected, controller 40 generates control signals directing actuator 32 to once again position print head 30 opposite to service station 34. As indicated by steps 422 and 424, additional servicing of print head 30 may be performed while the collected samples are analyzed. In particular, nozzles may be maintained by periodic spitting or firing of the nozzles of print head 30. Additional wiping may also be performed.

As indicated by step 428, analysis of the collected or captured samples may be performed while print head 30 is serviced. In particular embodiments, printing on media may also continue while the analysis is occurring, with any re-testing or adjustments being made after the results are available. As indicated by step 430, prior to sensing the captured samples, controller 40 first determines whether sensing system 336 (shown in FIG. 5) should be recalibrated. If a determination that recalibration of sensing system 336 to be performed, such calibration is performed as indicated in step 432. If recalibration using sensing system 336 is not to be performed, controller 40 proceeds with step 434.

As indicated by step 434, controller 40 generates control signals directing actuator 357 to reposition well plate 352 from the receiving position 363 to the filling position 361. Each of the wells which have received ejected fluid from nozzles of print head 30 are at least partially autofilled with a solution either before or after fluid ejection. According to one example embodiment, wells 359 in a 96 well plate are autofilled with approximately 200 μL of a buffer, such as citrate or phosphate. In other embodiments, other amounts of chemical reagent solution and other chemical reagent solutions may be used.

Once chemical reagent or buffer fluid has been deposited into wells 359, controller 40 generates control signals directing actuator 357 to move well plate 352 from the filling position 361 to the sensing position 365 adjacent to well plate reader 354. Thereafter, well plate reader 354 detects the absorbance or other optical property of the ejected fluid and autofilled solution contained within each of wells 359. This information is communicated to controller 40.

Although method 400 illustrates step 416 of ejecting fluid into wells 359 prior to filling of such wells 359 with a buffer, in other embodiments, the step 434 of filling wells 359 partially with a buffer may be performed prior to capturing the sample per step 416. By prefilling wells 359 with a buffer or chemical reagent, the risk that static buildup on the well plate 352 will pull drops off target may be reduced. In addition, such prefilling prior to fluid ejection from device 30 may enhance mixing.

As indicated by step 436, controller 40 determines the volume or dose of the fluid ejected from each of the tested nozzles using the optical property information received from well plate reader 354. Controller 40 further determines whether a particular quantity or dose goal for the particular nozzle or group of nozzles has been met. In other words, controller 40 determines whether the sensed volume for a particular nozzle is within performance specifications or within acceptable tolerances for the particular nozzle or grouping of nozzles.

As indicated by step 438, if the quantity or dose goal is met, well plate 352 is disposed of and print head 30 is once again positioned opposite to transport 26 for printing upon a target media 390 (shown in FIG. 5) as indicated by steps 440 and 442. Thereafter, target media 390 are printed upon until it is once again time to recalibrate ejection parameters.

As indicated by step 444, if the quantity or dose goal is not met for one or more of the tested nozzles, controller 40 determines whether minimum volume or dose thresholds are met to permit continued use of the one or more nozzles. As indicated by step 446, if the minimum dose thresholds are not met by enough nozzles, print head 30 is replaced. According to one embodiment print head 30 is replaced if the sensed dose is less than or equal to 70% of the dose specification or goal. In other embodiments, other thresholds may be employed.

As indicated by step 448, if the minimum quantity or dose threshold is attained such that the print head 30 is still usable, controller 40 adjusts or updates ejection parameters based upon the determined actual dose or volume coverage of the tested nozzle group of nozzles, or changes which nozzles are to be used. For example, in one embodiment, controller 40 may store the determined dosage or volume and the corresponding control signals and/or number of droplets ejected by the one or more nozzles which resulted in the sensed dose amount. The stored values are later used in subsequent printing upon target media. In another embodiment, controller 40 may adjust the number of droplets to be ejected by the tested nozzle or group of nozzles based upon the results to achieve various dose amounts. As indicated by arrow 450, upon replacement of the print head in step 446 or upon adjustment or updating of the print head ejection parameters per step 448, the one or more nozzles are once again tested. This process is repeated until the particular dose goal is met in step 436. After the dose goals are substantially met, printing upon target media is resumed.

Because each of printers 20, 220 and 320 and methods 100 and 400 test and verify the actual amounts or quantities of fluid actually ejected from individual nozzles or selected nozzle groupings repeatedly over the life of the print head, enhanced control over the amount of fluid ejected is achieved. This enhanced control facilitates use of printers 20, 220 and 320 in applications where precise control is beneficial such as a printing of diagnostic test strips, the printing of medicinal or other coatings upon drugs or medical devices, the dispensing of reagents and fluids for high-throughput screening and drug discovery, and the printing of electrically conductive and electrically semiconductive materials as part of semiconductor or micro-electromechanical machine (MEMs) fabrication. Such precise control may have benefits in other applications as well. Because sensing systems 36 and 336 are incorporated as part of such printers 20, 220 and 320, such enhanced control over the quantity or volume of fluids ejected is achieved without multiple space consuming separate systems and without duplication of componentry, such as power supplies.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

drop-on-demand inkjet nozzles;

a transport configured to position the nozzles and a target media opposite to one another;

a sensing system configured to receive fluid ejected from one or more of the nozzles and to sense a characteristic of the fluid;

a controller configured (1) to determine a quantity measurement of the fluid ejected from the one or more nozzles based on signals received from the sensing system, the quantity measurement having a coefficient of variation of less than or equal to about +/− ten percent, and (2) to generate control signals directing printing by the one or more nozzles based on the determined quantity; and a housing configured to support the nozzles, the transport, the sensing system and the controller.

2. The apparatus of claim 1, wherein the controller is configured to generate control signals directing the sensing system to receive and sense received fluid at predetermined time intervals between printing jobs by the one or more nozzles.

3. The apparatus of claim 1, wherein the controller is configured to generate control signals directing the sensing system to receive and sense received fluid after predetermined amounts of fluid have been ejected during print jobs by the one or more nozzles.

4. The apparatus of claim 1, wherein the sensing system comprises:

a well plate; and a well plate reader.

5. The apparatus of claim 4 further comprising a well plate filling device within the housing and configured to at least partially fill wells of the well plate with a chemical reagent and/or buffer.

6. The apparatus of claim 4, wherein the reader is configured to sense an optical property of the ejected fluid in the well plate and wherein the controller is configured to determine the quantity measurement of the ejected fluid based on the optical property.

7. The apparatus of claim 1, wherein the controller is configured to generate first control signals intended to cause the one or more nozzles to eject a target quantity of fluid into the receiver and wherein the controller is configured to generate second control signals different from the first control signals and based on the determined quantity to eject the target quantity onto the target media.

8. The apparatus of claim 1, wherein the sensing system is configured to receive the ejected fluid and wherein the ejected fluid includes a plurality of droplets that least partially overlap or intermix after being received by the sensing system.

9. The apparatus of claim 1, wherein a sensing device is selected from a group of sensing devices consisting of: a capacitive sensing device; a conductive sensing device; a gravimetric sensing device, a well plate and well plate reader sensing device and a scattering sensing device.

10. A method comprising:

performing a closed-loop arrangement of steps comprising:

ejecting fluid from one or more drop-on-demand inkjet nozzles onto a sensor receiver;

determining a quantity measurement of fluid received by the receiver, wherein the quantity measurement has a coefficient of variation of less than or equal to about +/−ten percent;

storing the determined quantity measurement for the one or more nozzles; and ejecting fluid from the one or more drop-on-demand inkjet nozzles onto one or more target media based on the stored quantity measurement for the one or more nozzles.

11. The method of claim 10, wherein the ejected fluid comprises a plurality of droplets having a volume of at least one nL.

12. The method of claim 11, wherein the closed-loop arrangement of steps further comprises:

comparing the determined quantity measurement with a quantity threshold; and discontinuing use or changing ejection parameters of a selected nozzles of the one or more nozzles based upon the comparison.

13. The method of claim 11, wherein determining the quantity comprises sensing an optical property of the fluid received by the receiver.

14. The method of claim 11, wherein the quantity is determined using a sensing device selected from a group of sensing devices consisting of: a capacitive sensing device; a conductive sensing device; a well plate and well plate reader sensing device; a gravimetric sensing device and a scattering sensing device.

15. The method of claim 10, wherein the closed-loop arrangement of steps further comprises moving the one or more nozzles from a first position opposite to one or more target media to a second position opposite the sensor receiver.

16. The method of claim 10, wherein the closed-loop arrangement of steps further comprises servicing the one or more nozzles.

17. The method of claim 10, wherein the receiver comprises a well plate and wherein the quantity measurement is determined based on a characteristic of the fluid received by the well plate and sensed by a well plate reader.

18. The method of claim 17, wherein the close-loop arrangement of steps further comprises depositing a chemical reagent or buffer in the well plate.

19. The method of claim 10, wherein the closed-loop arrangement of steps is performed by one or more devices contained in a single self-contained unit.

20. The method of claim 10, wherein the fluid comprises one or more inks and wherein the method further comprises ejecting the one or more inks onto a sheet to form an image on the sheet.

21. A method comprising:

ejecting fluid from one or more drop-on-demand inkjet nozzles into a receiver;

sensing a characteristic of the ejected fluid; and determining a quantity measurement of the ejected fluid based on the sensed characteristic, wherein the sensed characteristic has a sufficient correlation to a quantity of the fluid such that quantity measurements have a coefficient of variation of less than or equal to about +/−ten percent.

* * * * *